US006314934B1

(12) United States Patent
Ito et al.

(10) Patent No.: US 6,314,934 B1
(45) Date of Patent: Nov. 13, 2001

(54) LUBRICATING DEVICE FOR INTERNAL COMBUSTION ENGINE

(75) Inventors: Katsuhiko Ito; Masataka Eguchi; Hideyuki Tawara; Nobuyuki Yakigaya, all of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/654,135

(22) Filed: Sep. 1, 2000

(30) Foreign Application Priority Data

Sep. 4, 1999 (JP) ..... 11-289974
Sep. 5, 1999 (JP) ..... 11-291416

(51) Int. Cl.[7] ..... F01M 1/02

(52) U.S. Cl. ..... 123/196 R; 123/196 CP; 123/198 C

(58) Field of Search ..... 123/196 R, 196 CP, 123/198 C, 195 R, 195 C, 195 H

(56) References Cited

U.S. PATENT DOCUMENTS 5,606,943 * 3/1997 Tamba et al. ..... 123/90.23
6,161,515 * 12/2000 Kopec ..... 123/196 R

FOREIGN PATENT DOCUMENTS 1179109 12/1989 (JP) .
29904 1/1990 (JP) .
220430 * 8/2000 (JP) ..... F01M/11/02

* cited by examiner

*Primary Examiner*—Noah P. Kamen
*Assistant Examiner*—Hai Huynh
(74) *Attorney, Agent, or Firm*—Birch, Stewart, Kolasch & Birch, LLP

(57) ABSTRACT

In an engine having a dry sump type lubrication structure, a feed pump, a sub-scavenging pump, and a main scavenging pump of an oil pump are all integrally provided by disposing a feed pump rotor, a sub-scavenging pump rotor, and a main scavenging pump rotor in parallel on the same common drive shaft. This arrangement reduces the necessary size and weight of a feed pump and a scavenging pump while increasing the pumping capacity thereof The oil sump is divided into a plurality of oil sumps which are different from each other in their longitudinal and lateral positions. Oil in a first oil sump and a second oil sump is pumped by the main scavenging pump and sub-scavenging pump, respectively. A housing of the oil pump is composed of a first block, a second block, a third block, and a fourth block, wherein oil passages are provided in these blocks. The oil pumped by the main scavenging pump and the oil pumped by the sub-scavenging pump are collectively discharged in a collection discharge passage via the main scavenging pump discharge port and the sub-scavenging pump discharge port, respectively, and the oil thus collected is fed to the oil tank.

17 Claims, 4 Drawing Sheets

LUBRICATING DEVICE FOR INTERNAL COMBUSTION ENGINE

BACKGROUND OF THE INVENTION

1. Field of the Invention

The present invention relates to a lubricating device for an internal combustion engine that incorporates a dry sump type lubricating structure. An oil pump of the present invention incorporates a feed pump and a scavenging pump particularly intended to reduce size and weight dimensions and to offer an increase in pumping capacity.

2. Background Art

A dry sump type oil pump used for an internal combustion engine, including a feed pump and a scavenging pump, has been shown in Japanese Utility Model Laid-open No. Hei 1-179109 and Japanese Patent Laid-open No. Hei 2-9904. The former document discloses a feed pump and a scavenging pump which are separately provided.

Japanese Patent Laid-open No. Hei 2-9904 discloses a dry sump type lubricating device including a feed pump for supplying oil from an oil tank to portions of an engine requiring lubrication, and a scavenging pump for supplying oil that has been used for lubrication and has accumulated on the bottom of the engine to an oil tank. However, in this conventional arrangement, a feed pump and a scavenging pump are separately provided. This device further includes a relief valve provided in a discharge side passage of the feed pump, wherein a discharge port of the relief valve is communicated with a discharge side passage of the scavenging pump via a special passage.

However, since the feed pump and scavenging pump are provided as separate pumps, each of the aforementioned conventional systems suffers from the following shortcomings. First, the required number of parts is correspondingly increased with these conventional systems. In addition, the size and weight of the entire oil system is increased in the conventional systems. Furthermore, the structure and manufacturing process of the oil system is complicated with these conventional systems.

A vehicle running on a rough road or a steep slope, such as a four wheeled buggy or all-terrain vehicle, is often advantageously equipped with dry sump lubrication to ensure a minimum ground clearance and to reduce the center of gravity of the vehicle. However, with the aforementioned types of arrangements, an oil pan's structure must be designed with consideration of the inclination of the vehicular body during operation. This limits the degree of freedom in the design of an oil sump structure such as an oil pan. For example, the oil sump structure cannot be formed into a large irregular shape that potentially reduces clearance under conditions wherein the vehicle is inclined or operated on a steep slope.

This additional consideration results in additional design and manufacturing limitations for the designer. Accordingly, the present invention is aimed at solving the above-described problems.

SUMMARY OF THE INVENTION

The present invention overcomes the shortcomings associated with the prior art and achieves other advantages not realized by the prior art.

An object of the present invention is to provide a lubrication device for a dry sump type lubricated internal combustion engine that is compact in size and facilitates manufacture and assembly.

A further object of the present invention is to provide a lubrication device for a dry sump type lubricated internal combustion engine that is capable of reliably pumping oil throughout extreme vehicle operating conditions and inclinations.

A further object of the present invention is to provide a lubrication device for a dry sump type lubricated internal combustion engine that is more compact than conventional systems and offers greater pumping capacity.

A further object of the present invention is to provide a lubrication device for a dry sump type lubricated internal combustion engine that permits a vehicle minimum ground clearance that is unaffected by oil pan arrangement.

These and other objects are achieved by an oil pump for an internal combustion engine comprising a main feed pump for supplying oil from an oil tank to a plurality of portions of the engine requiring lubrication; a main scavenging pump for returning oil accumulating on a bottom of the engine to said oil tank, said feed pump and said scavenging pump being integrally assembled; a rotor of said main feed pump; a rotor of said main scavenging pump, each rotor disposed in parallel and on a common drive shaft; and at least one additional sub-scavenging pump, each additional sub-scavenging pump provided with a respective rotor integrally assembled and disposed in parallel on said common drive shaft These and other objects are achieved by an oil pump for an internal combustion engine comprising a feed pump for supplying oil from an oil tank to a plurality of portions of the engine requiring lubrication; a scavenging pump for returning oil accumulating on a bottom of the engine to said oil tank, said feed pump and said scavenging pump being integrally assembled; a rotor of said feed pump; a rotor of said scavenging pump, each rotor disposed in parallel and on a common drive shaft; and at least one additional feed pump, each additional feed pump provided with a respective rotor integrally assembled and disposed in parallel on said common drive shaft.

These and other objects are further achieved by a a lubricating device for an internal combustion engine comprising an oil tank; an oil sump for said engine; a feed pump for supplying lubricating oil in said oil tank to a plurality of portions of an engine requiring lubrication; a scavenging pump for returning the lubricating oil accumulating in each oil sump of the engine to said oil tank, wherein said oil sump of the engine is divided into a plurality of sections; and at least one additional scavenging pump is provided corresponding to said plurality of sections of said oil sump.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
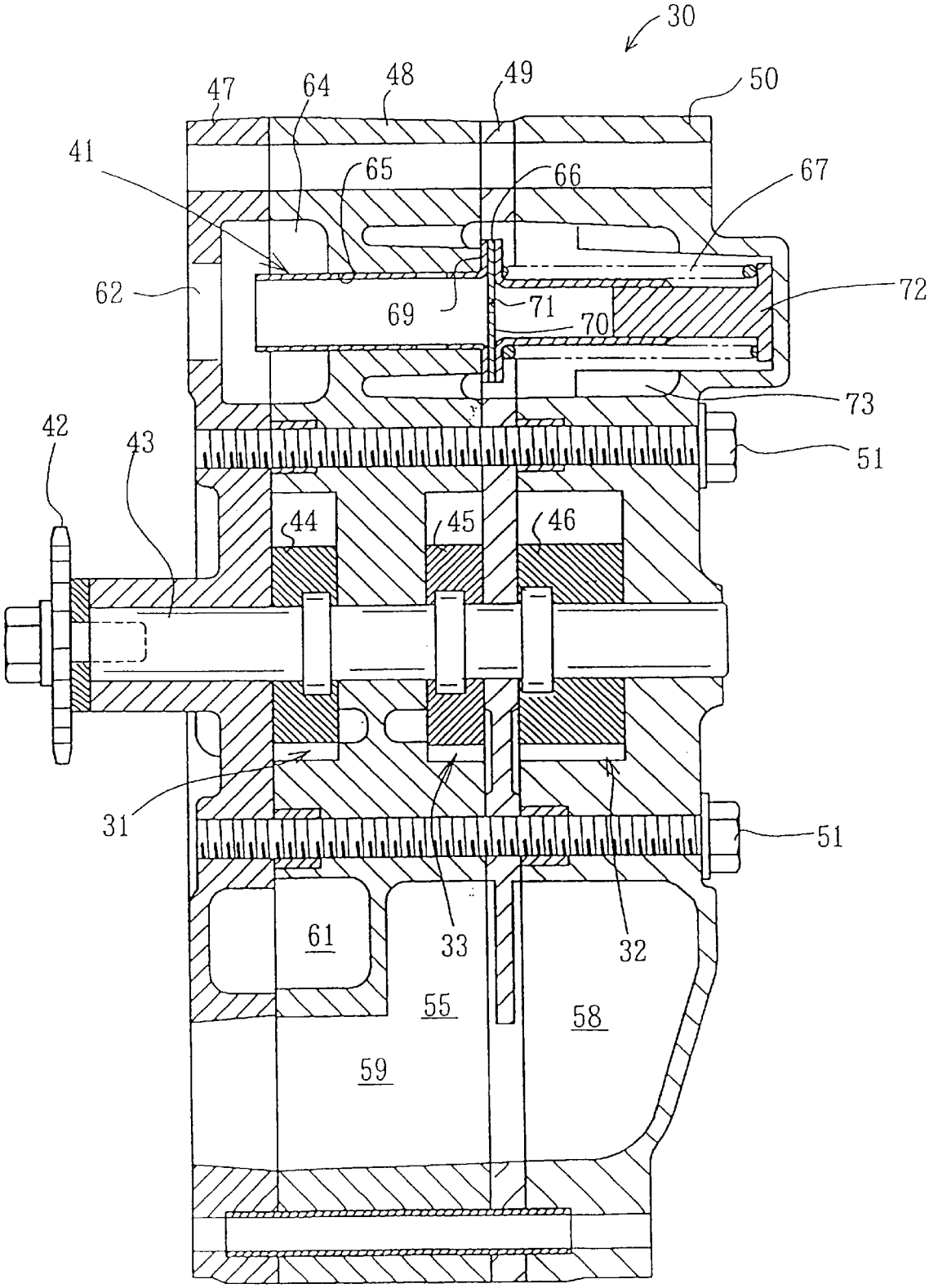
FIG. 1 is a sectional view of an oil pump according to an embodiment of the present invention.
Figure 2:
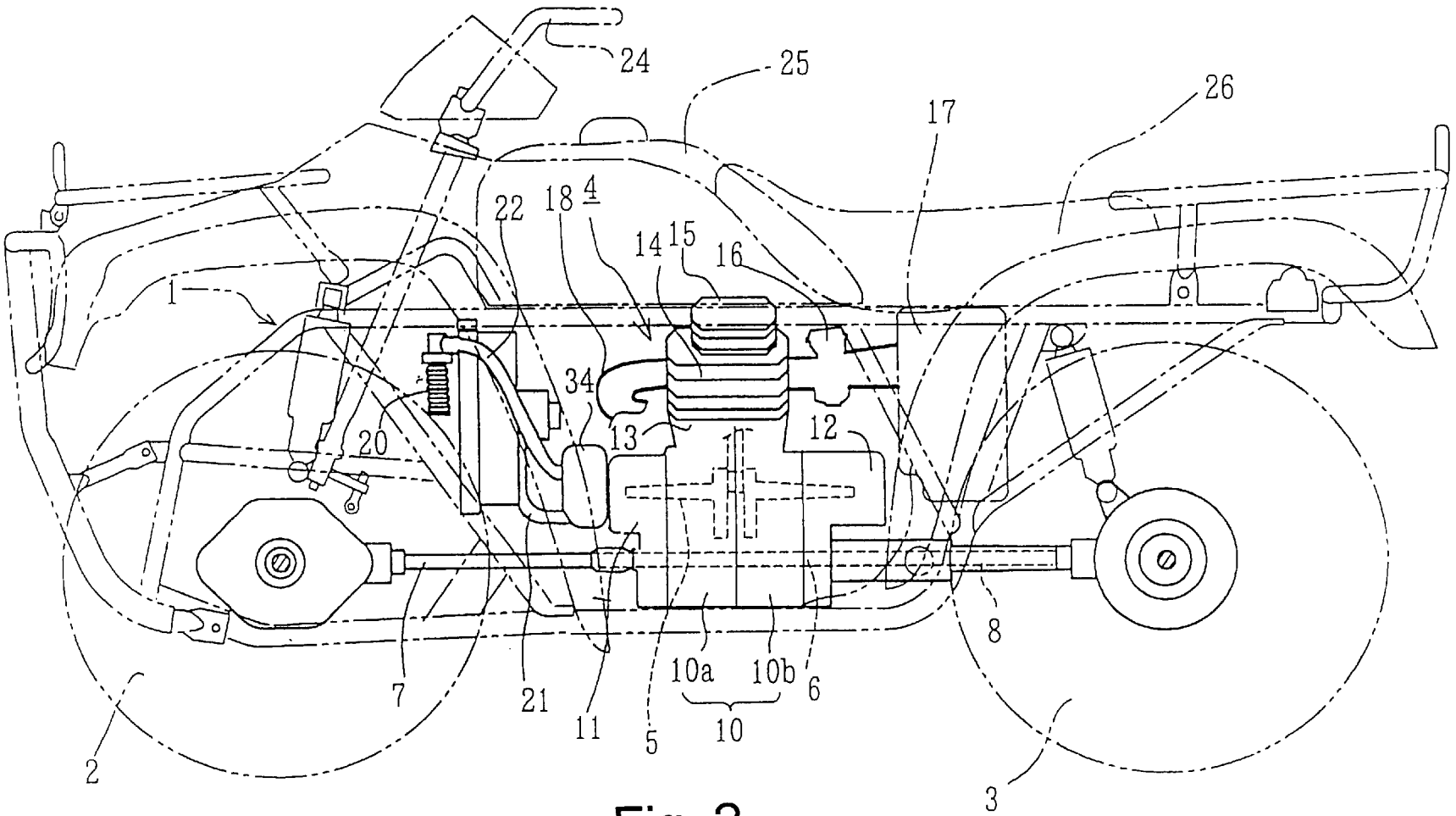
FIG. 2 is a side view of a preferred embodiment of the present invention showing the present invention applied to a portion of a vehicular body of a four-wheel buggy.
Figure 3:
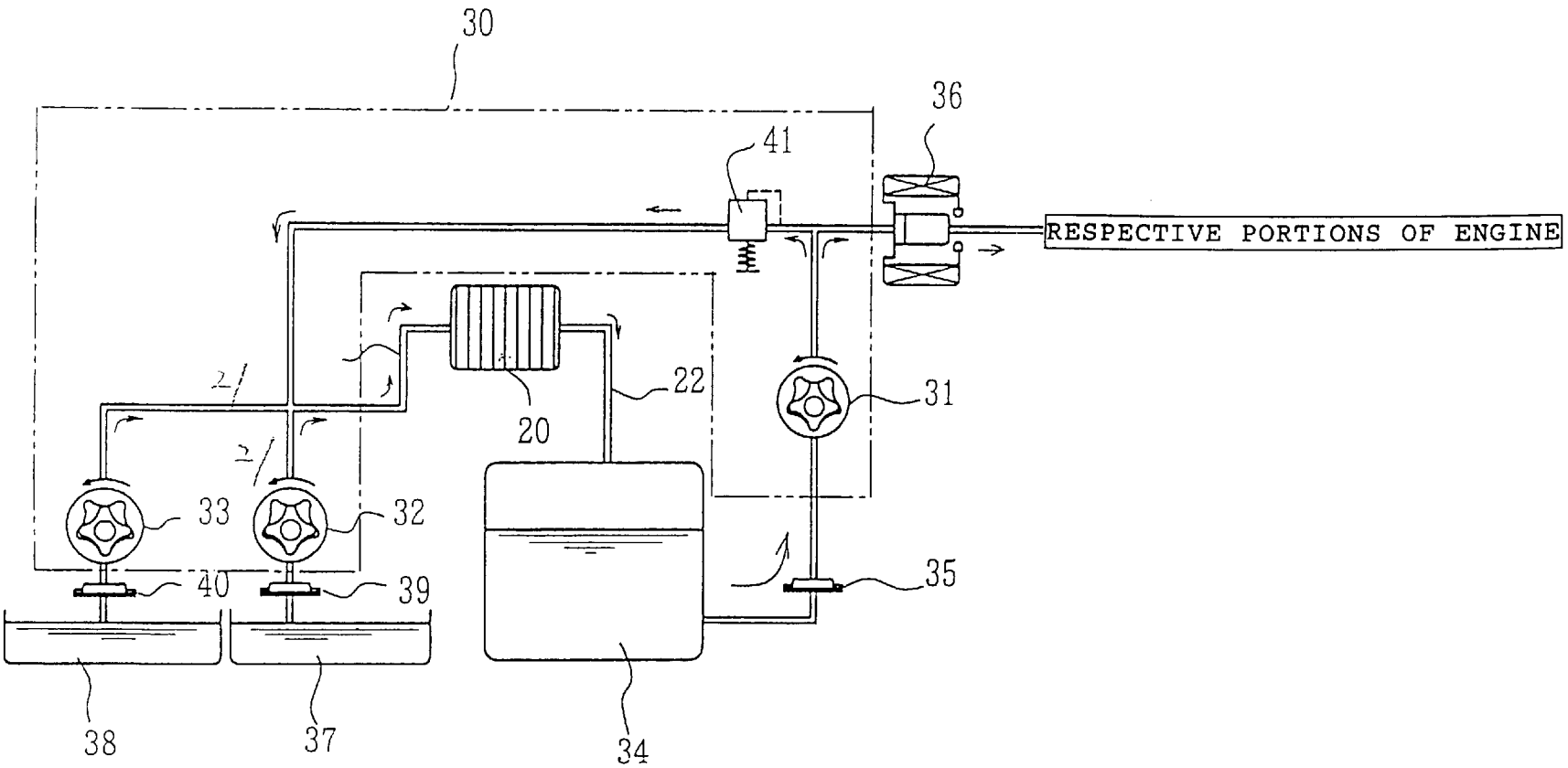
FIG. 3 is a schematic view of a lubrication system incorporating the present invention.
Figure 4:
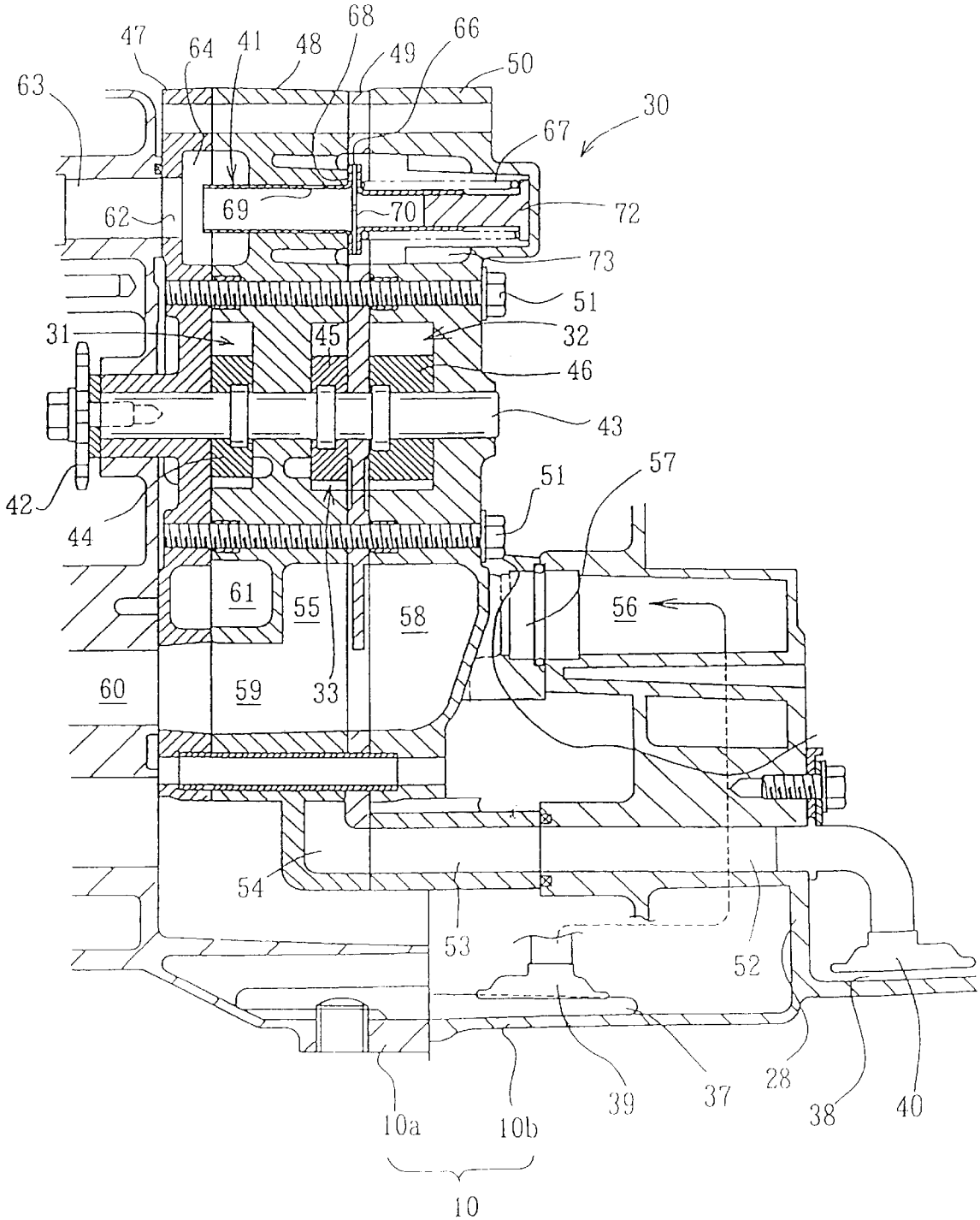
FIG. 4 is a sectional view of an oil pump and an associated oil passage structure according to an embodiment of the present invention.

An embodiment in which the present invention is applied to a four-wheel buggy will be described with reference to the accompanying drawings. FIG. 1 is a sectional view of an oil pump according to an embodiment of the present invention. FIG. 2 is a side view of a preferred embodiment of the present invention showing the present invention applied to a portion of a vehicular body of a four-wheel buggy. FIG. 3 is a schematic view of a lubrication system incorporating the present invention. FIG. 4 is a sectional view of an oil pump and an associated oil passage structure according to an embodiment of the present invention.

First, the entire structure of the four-wheel buggy will be described with reference; to FIG. 2. The four-wheel buggy includes a pair of right and left front wheels 2 and a pair of right and left rear wheels 3 on a front portion and a rear portion of a body frame 1, respectively, and a power unit 4 integrally including an engine and a transmission is supported by a central portion of the body frame 1. The power unit 4 is of a longitudinal type in which a crankshaft 5 is disposed in the longitudinal direction of the vehicular body.

The four-wheel buggy, which is of a four-wheel drive type, includes an output shaft 6 provided under the power unit 4 and in parallel to the crankshaft 5. The front wheels 2 are driven by an engine output transmitted from the output shaft 6 via a front wheel propeller shaft 7 and the rear wheels 3 are driven by the engine output transmitted from the output shaft 6 via a rear wheel propeller shaft 8.

The front side of a crankcase 10 of the power unit 4 is covered with a front case cover 11, and the rear side of the crankcase 10 is covered with a rear case cover 12. The crankcase 10 and the front and rear case covers 11 and 12 constitute a power unit case. The crankcase 10 is divided in the longitudinal direction into a front case 10*a* and a rear case 10*b*. A cylinder block 13, a cylinder head 14, and a cylinder head cover 15 are mounted on the upper portion of the crankcase 10. A carburetor 16 is connected to an intake port of the cylinder head 14, and an air cleaner 17 is connected to the rear side of the carburetor 16. An exhaust pipe 18 is connected to an exhaust port of the cylinder bead 14.

An oil cooler 20 is disposed in front of the power unit 4. The oil cooler 20 is communicated via a feed side hose 21 to an oil pump provided in the crankcase 10. The oil cooler 20 is also communicated via a return side hose 22 to the oil pump in the crankcase 10. In FIG. 2, reference numeral 23 designates a cooling fan, reference numeral 24 is a handlebar, reference numeral 25 is a fuel tan, and reference numeral 26 is a saddle type seat.

A dry sump type lubrication system of the power unit 4 will be described hereinafter. Referring to FIG. 4, an oil pump 30 provided in the power unit 4 has one feed pump 31, and two scavenging pumps. The two scavenging pumps are a main scavenging pump 32 and a sub-scavenging pump 33.

With reference to FIG. 3, the feed pump 31 sucks oil from an oil tank 34 via a strainer 35 and discharges the oil to an oil filter 36. The oil discharged from the oil filter 36 is fed to portions of the engine requiring lubrication.

After the oil has been used for lubrication, it is dropped and accumulated on an oil pan or oil sumps 37 and 38 located, for example, on the bottom of the crankcase 10. The oil sumps 37 and 38 are different from each other in height and arrangement in the longitudinal and lateral directions so that the oil can be pumped up by either of the scavenging pumps 32 and 33, even if there is a change in the posture of the vehicular body.

The oil accumulated in the oil sumps 37 and 38 is pumped up by the main scavenging pump 32 and the sub-scavenging pump 33 via strainer 39 and 40, respectively. Oil is then fed from the discharge sides of the pumps 32 and 33 to the oil cooler 20 via the feed side hose 21. The oil is then cooled by the oil cooler 20 and is returned again to the oil tank 34 via the return side hose 22. The oil tank 34 may be disposed either outside or inside the power unit 4.

A relief valve 41 is provided between a discharge side passage of the feed pump 31 and discharge side passages of the main scavenging pump 32 and the sub-scavenging pump 33. When a hydraulic pressure in the discharge side passage of the feed pump 31 exceeds a specific relief pressure, the excess pressure is relieved by opening the relief valve 41, so that the discharge oil from the feed pump 31 is fed, together with the discharged oil from the main scavenging pump 32 and the sub-scavenging pump 33, to the oil cooler 20 and oil tank 34.

Next, the configuration of the oil pump 30 of the present invention will be described with reference to the accompanying figures. Referring to FIGS. 1 and 4, the oil pump 30 is housed in the crankcase 10 in a position located between the front case 10a and rear case 10*b* of the crankcase 10. The oil pump 30 includes the feed pump 31, sub-scavenging pump 33 and main scavenging pump 32, each integrally driven by a common drive shaft 43. The drive shaft 43 has at a one end, a sprocket 42 rotatably driven by the crankshaft 5 via a chain (not shown) set in synchronization with the crankshaft 5.

Specifically, the rotor structure of the oil pump 30 is of a three rotor juxtaposition structure in which a feed pump rotor 44, a sub-scavenging pump rotor 45, and a main scavenging rotor 46 are disposed in parallel in the axial direction and are each integrally and rotatably mounted on the common drive shaft 43. The rotor portions constitute the three individual pumps 31, 32, and 33 provided in dependent pump chambers.

The pump housing of the oil pump 30 is divided in a direction perpendicular to the drive shaft 43 into four blocks: a first block 47, a second block 48, a third block 49, and a fourth block 50. These blocks are integrally connected with each other by means of a through bolt 51. The third block 49 serves as a partition wall between the sub-scavenging pump 33 and the main scavenging pump 32.

The sub-scavenging pump 33 pumps oil accumulated in the oil sump 38, via the strainer 40 provided above the oil sump 38, to a sub-scavenging pump inlet 52 formed in the rear case 10*b*. Oil is then sucked from the sub-scavenging pump inlet 52 up through a sub-passage 53 formed in the fourth block 50 and by a sub-passage 54 formed between the second and third blocks 48 and 49. Oil is then discharged to a sub-scavenging pump discharge port 55 formed in the second block 48.

The main scavenging pump 32 pumps oil accumulated in the oil sump 37 via the strainer 39 to a main scavenging pump inlet 56 provided in the rear case 10*b*. The oil sump 37 is located at a central portion of the bottom of the crankcase 10 and is lower than the oil sump 38. The oil is then pumped up through a main passage 57 formed in the fourth block 50 and discharges the oil to a main scavenging pump discharge port 58 formed in the fourth block 50.

The sub-scavenging pump discharge port 55 and the main scavenging pump discharge port 58 each communicate with a collection discharge passage 59. The oil discharged from each of the scavenging pumps 32 and 33 is fed via the collection discharge passage 59 to a scavenging pump discharge passage 60 formed on the front case 10*a* side, and is then fed via the feed side hose 21 to the oil cooler 20.

The feed pump 31 sucks oil from an oil inlet (not shown) formed in the front case 10*a* to a feed pump inlet 61 formed between the first block 47 and the second block 48. Oil is then fed to the oil filter 36 via a feed pump discharge port 62 provided in both the first and second blocks 47 and 48 and an oil filter communication passage 63 provided in the front case 10*a* in such a manner as to be communicated to the feed pump discharge port 62.

As is apparent from FIG. 1, a relief chamber 64 in communication with the feed pump discharge port 62 is formed in an upper portion of the oil pump 30 in such a manner as to extend from the first block 47 to the fourth block 50. An intermediate portion of the relief chamber 64 located at the second block 48 is configured as a small-diameter cylindrical portion 65 functioning as a narrow oil passage. The relief valve 41 is provided in the small-diameter cylindrical portion 65 so as to be liquid-tight and slidable in a direction parallel with the drive shaft 43.

The relief valve 41 is formed into a cylindrical shape and a flange 66 is provided, at an intermediate portion of the relief valve 41. The flange 66 is biased by a relief spring 67 to be pressed to a seat portion 68 provided at one end of the small-diameter cylindrical portion 65. A through-port 69 is provided in the relief valve 41 at a position offset on the feed pump discharge port 62 side of the flange 66. As long as the flange 66 is pressed against the seat portion 68, the through-port 69 is blocked with the inner wall of the small-diameter cylindrical portion 65. In this position, the oil in the relief valve 41 is prevented from escaping from the through-port 69.

A bulkhead 70 for partitioning the inside of the relief valve 41 into right and left parts is provided at the intermediate portion of the relief valve 41 where the flange 156 is provided. A pilot hole 71 is formed in the bulkhead 70 for communicating the right and left chambers thus partitioned with each other. An end portion opposite to the feed pump discharge port 62 of the relief valve 41 is inserted around the outer periphery of a guide 72 serving as a spring receiver for receiving one end of the relief spring 67. Therefore, as seen in FIG. 1, the opening at the right end of the relief valve 41 is blocked with the guide 72.

When the hydraulic pressure of the oil discharged to the feed pump discharge port 62 overcomes a relief pressure, that is, a set load applied to the relief spring 67, the relief valve 41 is moved in the direction where the relief spring 67 is compressed, so that the flange 66 is separated from the seat portion 68 to release the through-port 69 from the small-diameter cylindrical portion 65. As a result, the inside of the relief valve 41 is communicated with a relief chamber 64 on the fourth block 50 side, to escape part of the oil from the feed pump discharge port 62 side to the relief chamber 64, thereby reducing the discharge pressure of the feed pump 31 at a specific level.

A discharge port 73 at the end portion of the relief chamber 64 is directly communicated with the main scavenging pump discharge port 58. The oil that escaped in the relief chamber 64 is thereby returned to the main scavenging pump discharge port 58 and is collected in the collection discharge passage 59 with the oil discharged from the sub-scavenging pump discharge port 55 and the main scavenging pump discharge port 58. The oil is then collected in the collection discharge passage 59 and is fed to the oil cooler 20 side. The discharge port 73, main scavenging pump discharge port 58, sub-scavenging pump discharge port 55, and collection discharge passage 59 are passages directly and integraly formed in the housing of the oil pump 30.

As is apparent from FIG. 4, the oil sump 37 and the oil sump 38 on the bottom of the crankcase 10 are separated from each other in the longitudinal direction by a bulkhead 28.

The main scavenging pump 32 pumps up oil from the oil sump 37, and the sub-scavenging pump 33 pumps up oil from the oil sump 38. The oil sump 37 is located at a nearly central portion of the bottom of the crank case 10, at which oil is easy to be most accumulated when the posture of the vehicular body is normal. The oil sump 38 is disposed at the rear portion of the bottom of the crank case 10 and further, while not apparent in the figure, it is offset in the lateral direction of the crank case 10, to which oil is easy to move when the posture of the vehicular body is tilted in the longitudinal or lateral direction.

The function of this embodiment of the present invention will be described hereinafter. As shown in FIG. 1, the feed pump 31, sub-scavenging pump 33, and main scavenging pump 32 of the oil pump 30 are integrally formed with each other by disposing the feed pump rotor 44, sub-scavenging pump rotor 45, and main scavenging pump rotor 46 on the common drive shaft 43.

As compared with a structure in which the three pumps are separately provided, the structure in this embodiment is more advantageous since the number of parts can be reduced, the piping therebetween can be omitted, and the pumps in the crankcase 10 can be collectively arranged, thereby reducing the necessary arrangement space. As a result, it is possible to increase the capacity of each scavenging pump while still reducing the size and the weight of the entire oil pump 30. This results in a simplified structure of the oil pump 30 and further facilitates the manufacture thereof.

Since the main scavenging pumps 32 and the sub-scavenging pump 33 are each provided, oil in the oil sump 37 at the central portion in the longitudinal direction of the bottom of the crankcase 10 and oil in the oil sump 38 on the rear portion of the bottom of the crankcase 10 can be separately pumped by their respective scavenging pumps 32 and 33. As a result, it is possible to pump up oil accumulated on either of the oil sumps 37 and 38 and thereby perform stable lubrication even if there may occur a change in posture of the vehicular body.

In particular, since oil can be pumped up from the oil sump 38 by the sub-scavenging pump 33, lubrication can be effectively made even if the front portion of the vehicular body is raised, for example when the vehicle runs on a steep slope. Accordingly, it is possible to increase the degree of freedom in design of the bottom of the crankcase 10, and hence to easily lower the center of gravity of the vehicular body while keeping the minimum ground clearance necessary for the bottom of the crankcase 10. As a result, the structure in this embodiment can be suitably used for an all-terrain vehicle such as a four-wheel buggy having the dry sump type lubricating structure.

Further, since the discharge port 73 of the relief valve 41 is directly communicated to the main scavenging pump discharge port 58 in the fourth block 50, it is possible to eliminate the piping between the feed pump 31 and the main scavenging pump 32, and to thereby simplify the structure of the oil pump 30.

In particular, since oil is pumped up from the oil sump 38 positioned rearwardly from the oil sump 37 by the sub-scavenging pump 33, even if the front portion of the vehicular body is raised with respect to the rear portion of the vehicle, for example when the vehicle runs on a steep slope, lubrication can still be effectively made by the sub-scavenging pump 33. Although the oil level in the oil sump 37 is varied disadvantageously and is therefore difficult to be pumped up by the main scavenging pump 32, the oil in the opposite sump 38 is not. Since the oil in the oil sump 38 is moved to the corner portion of the bulkhead 28 in the oil sump 38 side, oil is still easily accumulated and is therefore easily pumped by the sub-scavenging pump 33.

Accordingly, the oil can be easily and optimally pumped by suitably arranging the main scavenging pump 32 and sub-scavenging pump 33 without the need of forming the bottom of the crank case 10 into such a shape as to be matched to a change in posture of the vehicular body for easily collecting the oil. This makes it possible to increase the degree of freedom in design of the bottom of the crank case 10 for the designer. Furthermore, it is also easier to lower the center of gravity of the vehicular body while maintaining the minimum ground clearance necessary for the bottom of the crankcase 10. As a result, the structure in this embodiment can be suitably used for an all-terrain vehicle such as a four-wheel buggy having a dry sump type lubrication structure.

The present invention is not limited to the above-described embodiments, and it is to be understood that various changes and variations may be made without departing from the scope of the present invention. For example, the rotor on the feed pump 31 side can be configured as a plurality of rotors, and each of the feed pump and scavenging pump can be configured as a plurality of pumps. The present invention can be also applied not only to a four-wheel buggy but also to any other vehicle having a dry sump type lubrication structure.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An oil pump for an internal combustion engine comprising:

a main feed pump for supplying oil from an oil tank to a plurality of portions of the engine requiring lubrication;

a main scavenging pump for returning oil accumulating on a bottom of the engine to said oil tank, said feed pump and said scavenging pump being integrally assembled;

a rotor of said main feed pump;

a rotor of said main scavenging pump, each rotor disposed in parallel and on a common drive shaft; and at least one additional sub-scavenging pump, each additional sub-scavenging pump provided with a respective rotor integrally assembled and disposed in parallel on said common drive shaft.

2. The oil pump according to claim 1 further comprising at least one additional feed pump, each additional feed pump provided with a respective rotor integrally assembled and disposed in parallel on said common drive shaft.

3. The oil pump according to claim 1 further comprising:

a relief valve;

an oil pump housing, wherein said relief valve is provided in said pump housing facing a discharge side passage of said feed pump; and a discharge port of said relief valve is communicated to a discharge side scavenging passage.

4. The oil pump according to claim 3, wherein said relief valve is a spring-biased relief valve for relieving excess lubricating pressure from said main feed pump.

5. The oil pump according to claim 3, wherein said oil pump housing includes a plurality of blocks and oil passages.

6. The oil pump according to claim 3, wherein the pump housing of the oil pump is divided in a direction perpendicular to the drive shaft into a first block, a second block, a third block, and a fourth block, wherein said blocks are integrally connected by means of a through bolt.

7. The oil pump according to claim 6, wherein said third block serves as a partition wall between each sub-scavenging pump and said main scavenging pump.

8. The oil pump according to claim 3, further comprising:

a sub-scavenging pump inlet provided in a rear case of said pump housing;

a main scavenging pump inlet provided in said rear case;

a sub-scavenging pump discharge port;

a main scavenging pump discharge port; wherein oil is pumped through each pump discharge port and is collectively discharged to said discharge side scavenging passage.

9. The oil pump according to claim 1, wherein each scavenging pump collectively discharges oil to a common collection discharge passage via respective discharge ports.

10. The oil pump according to claim 1, wherein each sub-scavenging pump and said main scavenging pump pump oil accumulated in a respective first and second oil sump.

11. The oil pump according to claim 10, wherein said first sump is provided in a position longitudinally and laterally offset from said second sump.

12. An oil pump for an internal combustion engine comprising:

a feed pump for supplying oil from an oil tank to a plurality of portions of the engine requiring lubrication;

a scavenging pump for returning oil accumulating on a bottom of the engine to said oil tank, said feed pump and said scavenging pump being integrally assembled;

a rotor of said feed pump;

a rotor of said scavenging pump, each rotor disposed in parallel and on a common drive shaft; and at least one additional feed pump, each additional feed pump provided with a respective rotor integrally assembled and disposed in parallel on said common drive shaft.

13. A lubricating device for an internal combustion engine comprising:

an oil tank;

an oil sump for said engine;

a feed pump for supplying lubricating oil in said oil tank to a plurality of portions of an engine requiring lubrication;

a scavenging pump for returning the lubricating oil accumulating in each oil sump of the engine to said oil tank, wherein said oil sump of the engine is divided into a plurality of sections; and at least one additional scavenging pump is provided corresponding to said plurality of sections of said oil sump.

14. The lubricating device according to claim 13, wherein each scavenging pump includes a respective rotor disposed in parallel on a common oil pump drive shaft.

15. The lubricating device according to claim 13, wherein said lubricating device is a dry sump type oil pump.

16. The lubricating device according to claim 13, wherein said plurality of sections of said oil sump are separate oil sumps and each separate oil sump is provided longitudinally and laterally offset from a respective separate oil sump.

17. The lubricating device according to claim 16, wherein each separate oil sump is separated by a bulkhead provided in an oil pump housing.

* * * * *